US006874432B2

(12) United States Patent
Lanphear

(10) Patent No.: US 6,874,432 B2
(45) Date of Patent: Apr. 5, 2005

(54) VERTICALLY ADJUSTABLE TABLE

(76) Inventor: John S. Lanphear, 48860 48th Ave., Lawrence, MI (US) 49064

( * ) Notice: Subject to any disclaimer, the term of this patent is extended or adjusted under 35 U.S.C. 154(b) by 63 days.

(21) Appl. No.: 10/259,488

(22) Filed: Sep. 30, 2002

(65) Prior Publication Data

US 2003/0024446 A1 Feb. 6, 2003

Related U.S. Application Data

(63) Continuation-in-part of application No. 10/061,300, filed on Feb. 4, 2002, now abandoned, which is a continuation of application No. 09/443,357, filed on Nov. 19, 1999, now Pat. No. 6,343,556.

(60) Provisional application No. 60/109,200, filed on Nov. 20, 1998.

(51) Int. Cl.[7] ..... A47B 9/00

(52) U.S. Cl. ..... 108/147; 248/631

(58) Field of Search ..... 108/147, 148, 108/146, 144.11, 147.19; 248/188.5, 631, 676, 357

(56) References Cited

U.S. PATENT DOCUMENTS

| | | | | |
|---|---|---|---|---|
| 2,819,134 A | | 1/1958 | Klevholm | |
| 3,311,337 A | | 3/1967 | Muller Vom Hagen | |
| 3,820,176 A | * | 6/1974 | Feiertag | 108/147 |
| 3,915,102 A | | 10/1975 | Barron | |
| 4,159,822 A | | 7/1979 | Ota et al. | |
| 4,374,497 A | | 2/1983 | Harmand | |
| 4,723,808 A | | 2/1988 | Hines | |
| 4,752,102 A | | 6/1988 | Rasmussen | |
| 5,431,369 A | | 7/1995 | Hung | |
| 5,437,236 A | | 8/1995 | Zeiner | |
| 5,551,668 A | | 9/1996 | Hung | |
| 5,588,377 A | | 12/1996 | Fahmian | |
| 5,636,394 A | * | 6/1997 | Bartley | 108/147 |
| 5,694,864 A | | 12/1997 | Langewellpott | |
| 5,778,803 A | | 7/1998 | Machael | |
| 5,884,882 A | * | 3/1999 | Nada et al. | 248/188.2 |
| 6,021,722 A | * | 2/2000 | Raycraft | 108/147 |
| 6,029,585 A | | 2/2000 | Tabayashi | |
| 6,092,474 A | * | 7/2000 | Chen | 108/147 |
| 6,343,556 B1 | * | 2/2002 | Lanphear | 108/147 |
| 6,494,150 B1 | * | 12/2002 | Phoenix et al. | 108/147 |
| 6,540,191 B2 | * | 4/2003 | Liu | 248/422 |

FOREIGN PATENT DOCUMENTS

| | | | |
|---|---|---|---|
| DE | 2503078 | * | 7/1976 |

* cited by examiner

*Primary Examiner*—Jose V. Chen
(74) *Attorney, Agent, or Firm*—Diederiks & Whitelaw, PLC

(57) ABSTRACT

An adjustable height table includes a base frame, a slider frame assembly, a generally planar support surface and a lifting mechanism. The main portion of the base frame is formed by welding three tubular components to form an H-shape. Each of the end portions of the H-shape include a mounting to support a swiveling locking castor. Above each castor there extends from the H-shaped main portion, a vertically extending tubular post. The slider frame assembly preferably includes an H-shaped main portion formed of three tubular members. Four vertically extending hollow tubular column members are attached to the H-frame so that they may telescopingly engage the four vertically extending posts of the base frame. A generally planar support surface is attached to the top of the four vertically extending columns located on the slider frame. Located between the central tube of the H portion of the base frame and central tube of the slider frame assembly, there is located a lifting mechanism, preferably a hydraulic jack or a pair of electric motors. This jack can be actuated by a pedal mechanism to lift the slider frame assembly relative to the base frame. A second pedal is provided in the lifting mechanism to have the slider frame lower at a controlled rate of descent. Additionally an anti-sway bar is provided to prevent the lifting pump pedal from swaying side to side when in use.

9 Claims, 8 Drawing Sheets

VERTICALLY ADJUSTABLE TABLE

CROSS REFERENCE TO RELATED APPLICATIONS

This application is a continuation-in-part of U.S. Ser. No. 10/061,300 filed on Feb. 4, 2002, now abandoned which is a continuation of U.S. patent application Ser. No. 09/443,357 filed on Nov. 19, 1999, now U.S. Pat. No. 6,343,556 which claims benefit of U.S. Provisional Application 60/109,200 filed on Nov. 20, 1998.

BACKGROUND OF THE INVENTION

1. Field of the Invention

The present invention relates to adjustable height portable tables, and, more particularly, to a portable table which can be easily raised or lowered by using a jack.

2. Description of Related Art

Recently there has become a need to have a portable and easily adjustable table which can vary its height. For the reasons discussed below, the table must be extremely stable and, in addition, be free from any type of clutter beneath its supporting surface. Such tables can find use in various environments, such as in offices, restaurants, factories and machine shops. For example, if the table were to be used as a welding fixture to support articles as they are welded together, it would be very important for the table to have all of the above-mentioned features. Therefore, it would be important that the table be portable so that it may be moved to whatever part of the shop that the welding is to be done. The table has to be extremely stable so that the table does not jostle, for example, when its height is being adjusted, and the table needs to be fairly clear from clutter so that various items, such as tanks for the welding equipment, can be stored underneath the table. Of particular importance, of course, is the ability for the table to adjust its height so that welding personnel can easily access various parts of equipment being worked on. Previously designs of a welding fixture were typically a fixed table which, since it could not be moved from place to place or have its height adjusted, are not satisfactory.

Another proposed solution to the problem is to use a certain type of jack to make a welding table adjustable. Such a jack typically is simply removed, for example, from a trailer hitch and placed on a two part table so that when the jack is actuated, the table top moves up and down. This of course suffers from a major drawback in that the jack is so incredibly large that it takes up all storage space under the table and tends to be of a clumsy design.

Yet another proposal to overcome the problems stated in the prior art is represented by U.S. Pat. No. 5,437,236 which discloses a multi-functional table with elevational capabilities. In that patent, there is proposed the use of a hydraulic jack between a base and a table top. This arrangement is considered to suffer two major disadvantages in that, first of all, the table is not portable and may not be easily moved from place to place in a machine shop and, more importantly, the table is not stable. While the patent does recognize its own deficiency in the table not being stable enough and does try to correct the situation by proposing using four telescoping supports as shown in FIG. 13, it is still woefully lacking in any type of frame structure which would provide the necessary support for proper welding work.

Accordingly, it is desirable to provide a portable, adjustable height table which does not suffer the drawbacks mentioned above and furthermore is easily adjustable in height, readily portable, and lacks any type of clutter below its main support surface.

SUMMARY OF THE INVENTION

The present invention includes a portable, adjustable height load bearing structure or table comprising an adjustable height table, a base frame, a slider frame assembly, a generally planar support surface and a lifting mechanism. The main portion of the base frame is formed by welding three tubular components to form an H-shape. Each of the lower end portions of the H-shape includes a mounting to support a swiveling, locking castor. Above each castor, there extends from the H-shaped main portion, a vertically extending tubular column. The slider frame assembly includes an H-shaped main portion formed of three tubular members. Four vertically extending hollow tubular column members are attached to the H-frame of the slider frame assembly, so that they may telescopingly engage the four vertically extending column members of the base frame. A generally planar support surface is attached to the top of the four vertically extending columns located on the slider frame assembly. Between the central tube of the H portion of the base frame and the central tube of the slider frame assembly, there is located a lifting mechanism, preferably a hydraulic jack. This jack can be actuated by a pedal mechanism to lift the slider frame assembly relative to the base frame. A second pedal is provided in a lifting mechanism to control the jack in order to lower the slider frame assembly at a controlled rate of descent. Additionally, an anti-sway bar is provided to prevent the lifting pump pedal from swaying when in use.

In another preferred embodiment between the base frame and the slider frame assembly, there is located a lifting mechanism, preferably an electric motor operated jack. The motor can be actuated by push button controls or any other control mechanism easily operated by welding personnel or other people who need to adjust the height of the load bearing structure or table.

The foregoing and other novel features and advantages of the invention will be better understood upon reading the following detailed description taken in conjunction with the accompanying drawings in which like reference numerals refer to like parts in each of the figures.

DETAILED DESCRIPTION OF THE PREFERRED EMBODIMENTS

Figure 1:
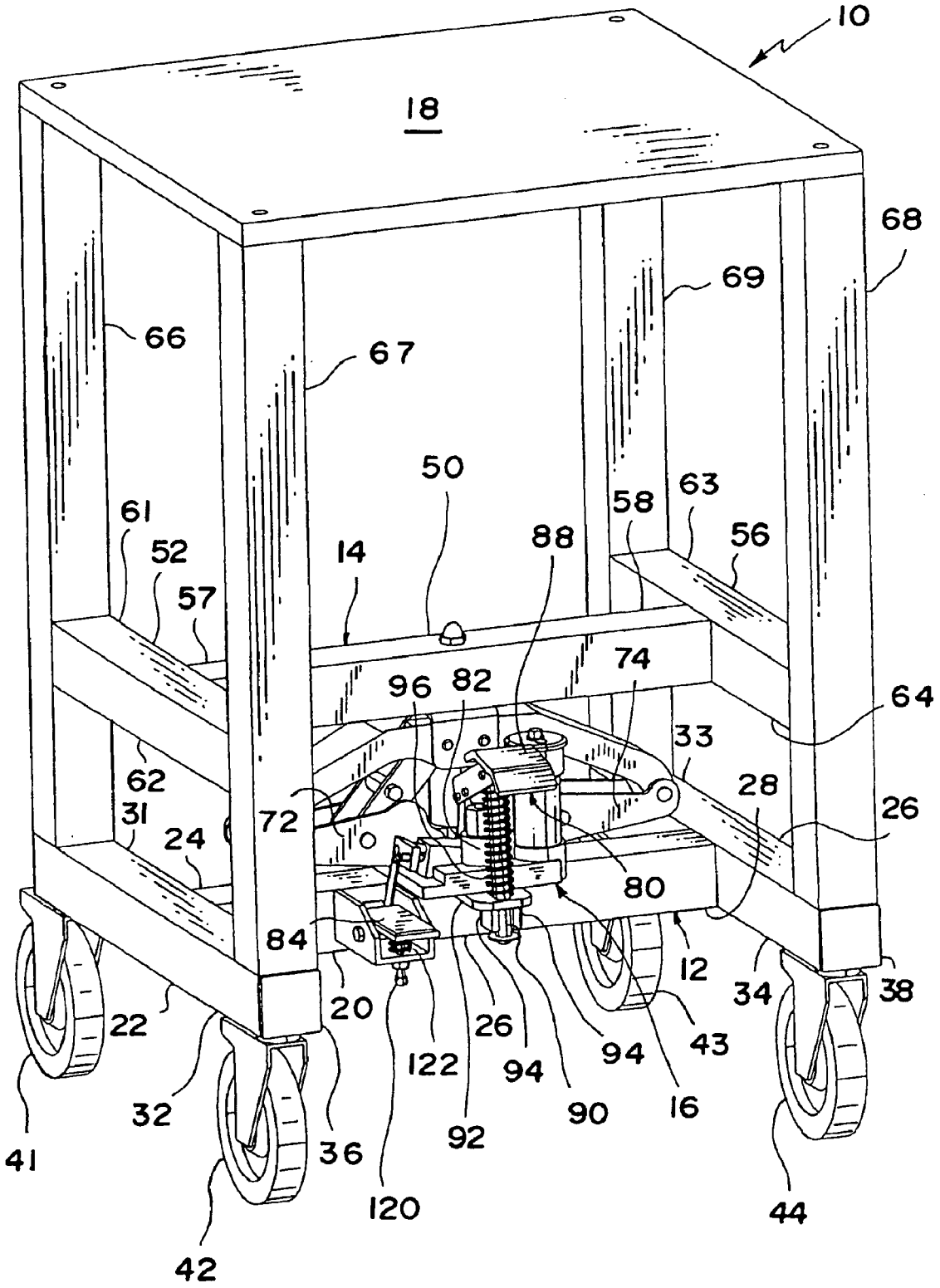
FIG. 1 is a perspective view of the first embodiment of a table constructed in accordance with the principals of the invention wherein the table is in its lowermost adjustable position.

Although the present invention will be described hereinafter in the context of an adjustable height welding table for use in a machine shop, it will be appreciated that the invention is equally applicable to load bearing structures of many different types used in a variety of different applications. For example, the adjustable table can be used in office environments, restaurants or, for example, as a portable inspection station in a factory environment. Also please note that the terms vertically, horizontally, up, down and the like are used for convenience and simply refer to the table of the preferred embodiment of this invention in its natural upright position as shown in the drawings. These terms are therefore not to be considered limiting.

Referring to the drawings and initially to FIG. 1, an adjustable height table constructed in accordance with the invention is generally designated by the reference numeral 10 and includes an H-shaped base frame 12, an H-shaped slider frame assembly 14, a lifting mechanism 16 and a generally planar support surface or tabletop 18. As can best be seen in FIGS. 1 and 2, the base frame 12 includes a first hollow, elongated tubular member 20 extending along a first axis. A second hollow tubular member 22 extends at right angles thereto and is welded at one end 24 of first tubular member 20 and a third tubular member 26 also extends at right angles to the first tubular member 20 and is welded to the other end 28 of the first tubular member 20. The result is a generally H-shaped base frame 12 having four laterally extending arms. These tubular members 20, 22, 26 are preferably made of steel or stainless steel construction and are painted to a desirable color. They could, however, also be made of aluminum or other construction materials. At the end of each of the laterally extending arms 31, 32, 33, 34 there is provided a cap 36, 38, only two are shown formed to close off the hollow tube. These caps 36, 38 are typically square and made of plastic and are mainly for aesthetic purposes, but they also help to keep dust and other foreign materials out of the H-shaped base frame 12.

The base frame 12 typically extends in a horizontal plane during normal use. Attached to extreme ends of each of the laterally extending arms 31, 32, 33, 34 and extending in the downward direction is a group of four casters 41, 42, 43, 44. Typically, these castors are allowed to swivel about their vertical axes in order to aid in moving the table 10 from place to place. In addition, preferably these castors 41, 42, 43, 44 have the ability to lock in place once the table 10 has been moved to a preferred location. Preferably six inch swivel locking castors are used, however, any type of castor may be used with the table 10 depending on the working conditions. For example, in cases of extreme heat or heavy loading, different types of castors might be chosen.

Figure 2:
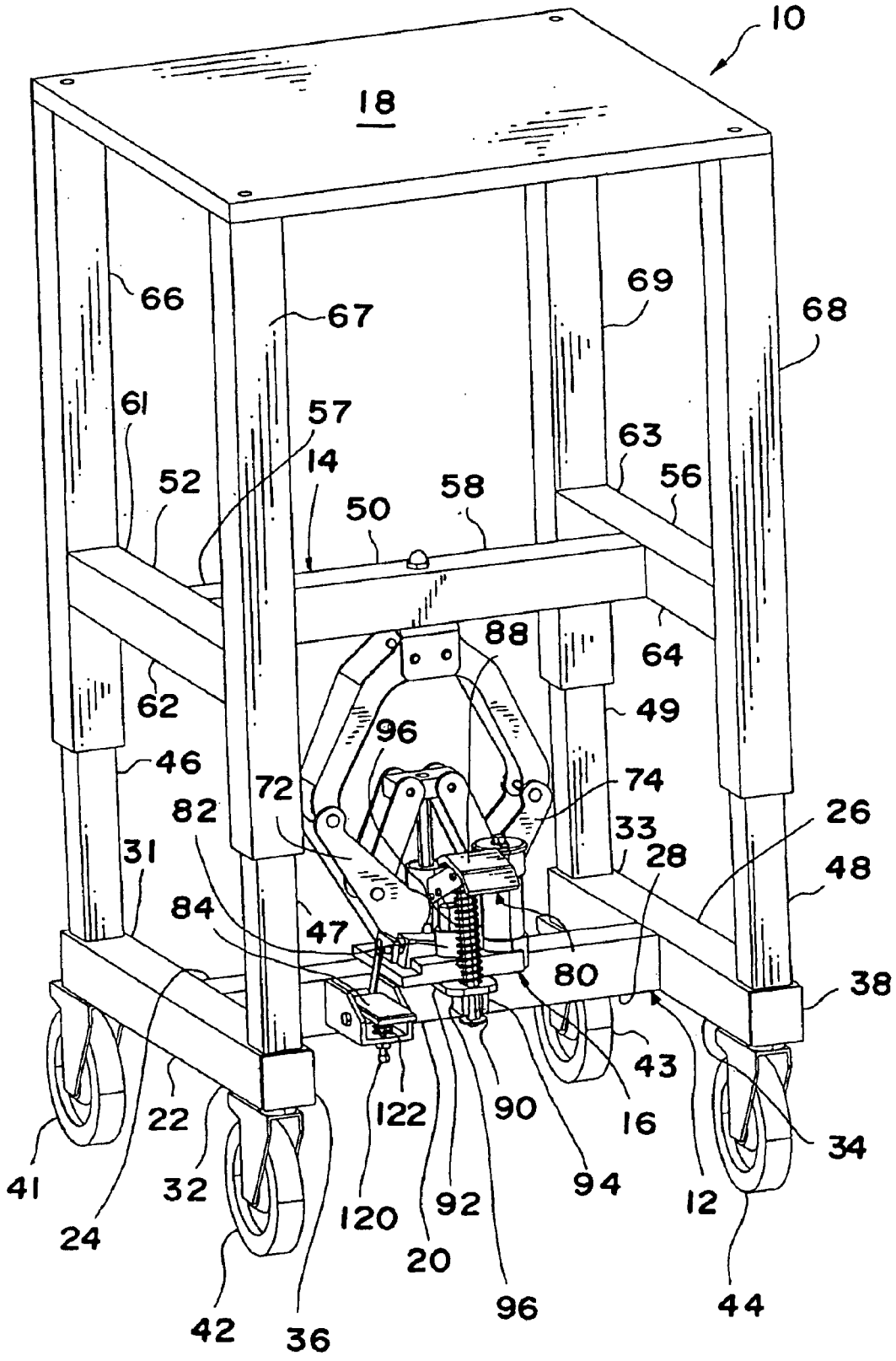
FIG. 2 is a perspective view of the table of FIG. 1 in its uppermost position.

At the extremes ends of these lateral arms 31, 32, 33, 34, as can best be seen in FIG. 2, there are located four vertically extending hollow tubular posts 46, 47, 48, 49 welded to the laterally extending arms 31, 32, 33, 43. These hollow tubular posts 46, 47, 48, 49 extend opposite to the castors 41, 42, 43, 44 and preferably extend vertically so as to cooperate with the slider frame assembly 14 as will be discussed more fully below.

Turning now to the slider frame assembly 14, the slider frame assembly 14 also comprises three hollow tubular members 50, 52, 56 of similar materials to the tubular members 20, 22, 26 in the base frame 12. An initial hollow elongated tubular member 50 extends generally parallel to the first hollow tubular member 20 of the H-shaped base frame 12 and is located just above the initial hollow elongated tubular member 20. Attached to each end 57, 58 of hollow elongated tubular member 50 are two hollow elongated tubular members 52, 56 which extend at 90° thereto to form the H-shaped slider frame assembly 14. The two tubular members 52, 56 define four lateral arms 61, 62, 63, 64. At the end of each of these lateral arms 61, 62, 63, 64 there is a respective vertically extending tubular column 66, 67, 68, 69 which is welded to the respective laterally extending arms 61, 62, 63, 64. Note that the laterally extending arm 61, 62, 63, 64 of the slider frame assembly 14 are slightly shorter than the laterally extending arms 31, 32, 33, 34 of the base frame 12 as best seen in FIGS. 1 and 2. This is to assure that the vertical columns 66, 67, 68, 69 of the slider frame assembly 12 are positioned so that they may slide telescopingly with the upper ends of the vertically extending posts 41, 42, 43, 44 located on the base frame 12.

Note that all of the tubular members preferably have a square cross section as shown in the figures. However, any cross section will do, so long as the slider frame assembly 14 and base frame 12 may cooperate in a telescoping manner. For example, circular, rectangular, or oblong cross sections, etc. are perfectly acceptable.

The generally planar support surface or tabletop 18 may be made of several different materials. Two preferable materials are shown in FIGS. 4–7. More specifically, in FIGS. 4 and 5, there are shown a maple block top or other type of wood planar board. In this configuration, an elongated rectangular insert 100 is placed on the top of the vertical columns 66, 67, 68, 69 of the slider from assembly 14 and welded thereto. A hole 102 is formed in the rectangular insert 100 to receive a screw 104 which may be added from underneath the tabletop 18 to secure the tabletop 18 on the slider frame assembly 14. Using this type of connection, no screws or imperfections may be found seen on the top of the wooden block tabletop 18.

Figure 7:
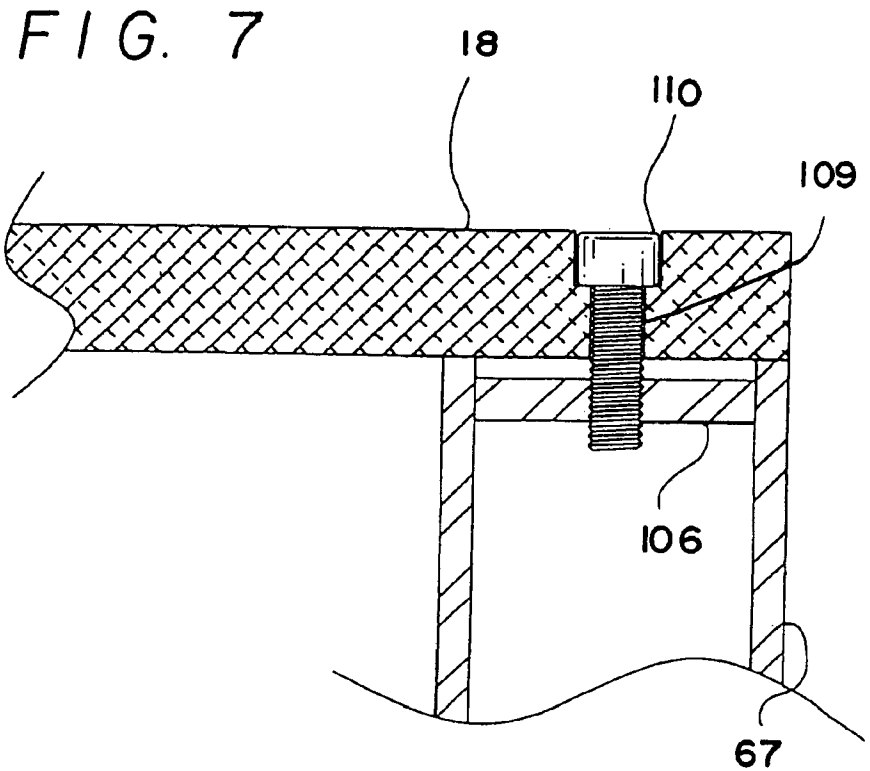
FIG. 7 is a cross-sectional front view of the connection between the sliding frame and the generally planar support surface of a second embodiment of the invention.
Figure 6:
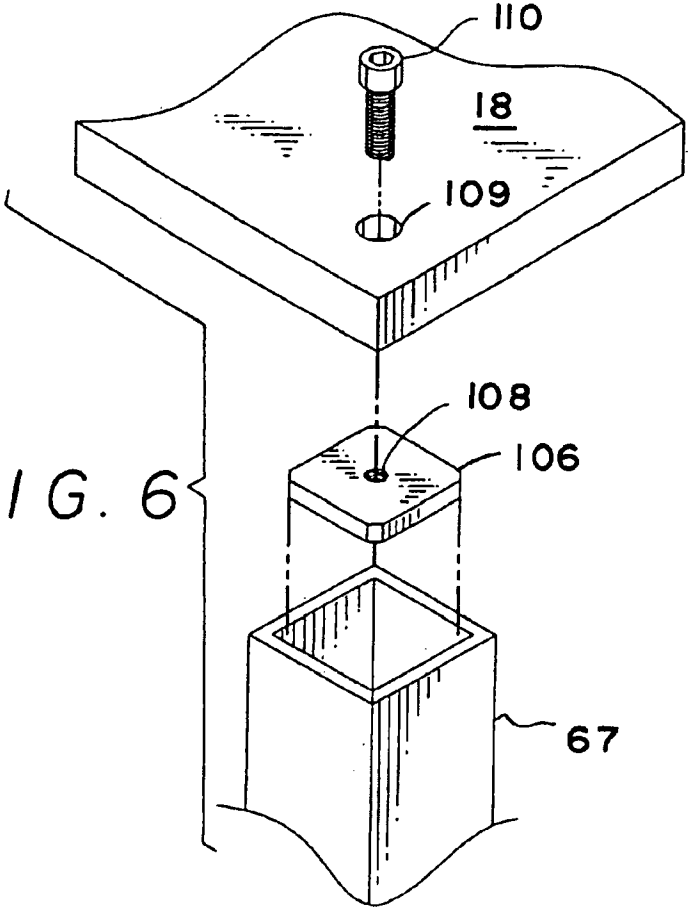
FIG. 6 is an exploded perspective view of the connection between the slider frame and the generally planar support surface of a second embodiment of the invention.

Alternatively, in another preferred embodiment as shown in FIGS. 6 and 7, a separate square fastener 106, having a threaded hole 108 formed therein, may be secured, such as by welding, within the tubular columns 66, 67, 68, 69 of the slider frame assembly 14. The generally planar surface or tabletop as shown in FIGS. 6 and 7 is made of metal such as aluminum or other materials and has a recessed hole 109 in its top which may easily accept a bolt 110 such that the bolt 110 may be screwed through the top of the table 18 and into an insert 106 located in a respective one of the vertically extending tubular columns 66, 67, 68, 69 located on the slider frame assembly 14.

In any event, it is important to note that any convenient type of connection between the slider frame assembly 14 and the tabletop 18 may be used. In fact it is envisioned that these vertically adjustable portable combination base frame 12/slider frame assemblies 14 may be sold without any top at all so that a customer may provide their own custom made supporting surface.

Figure 3:
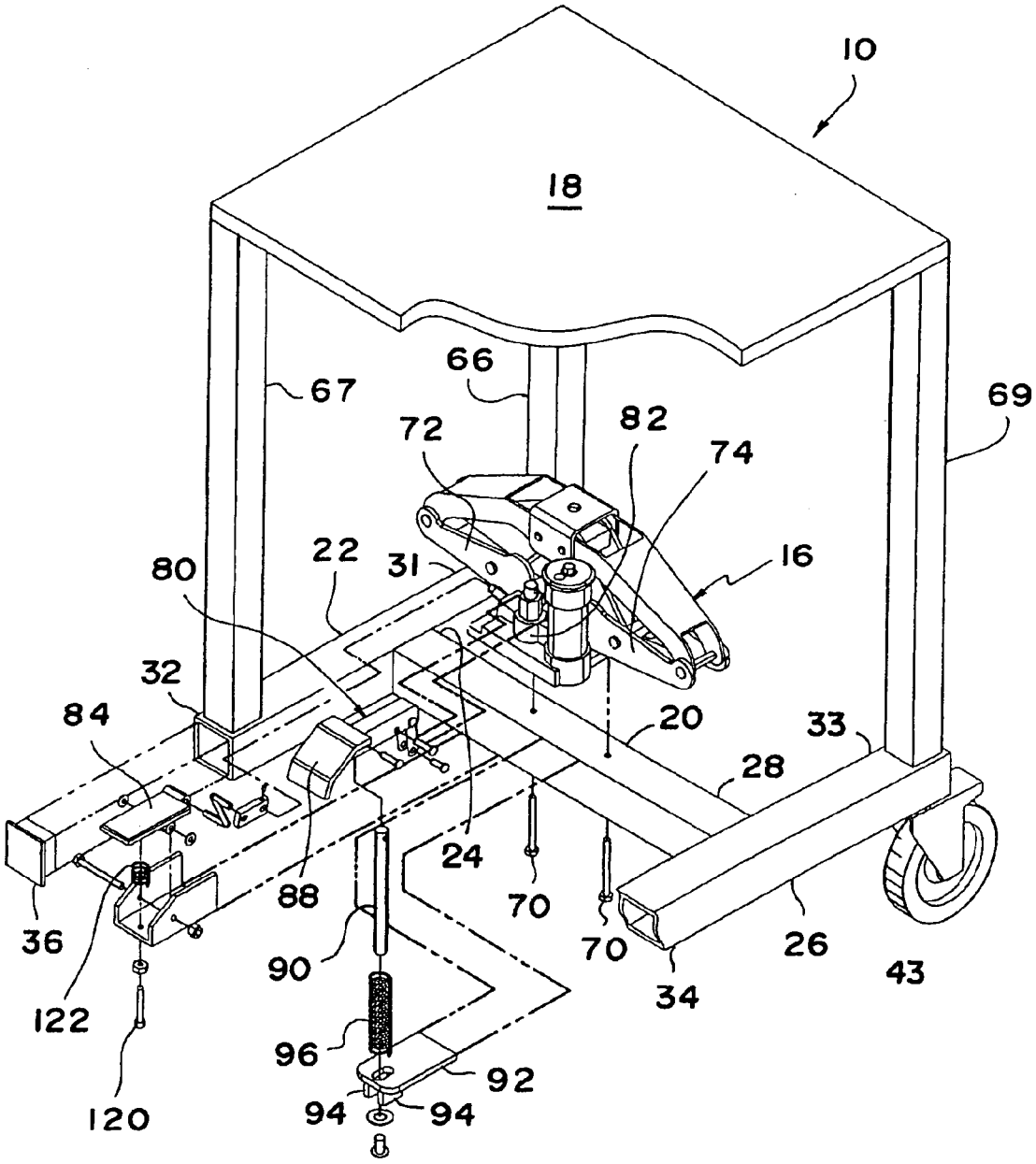
FIG. 3 is an exploded view of a lift mechanism incorporated in the preferred embodiment of the table shown in FIG. 1.
Figure 5:
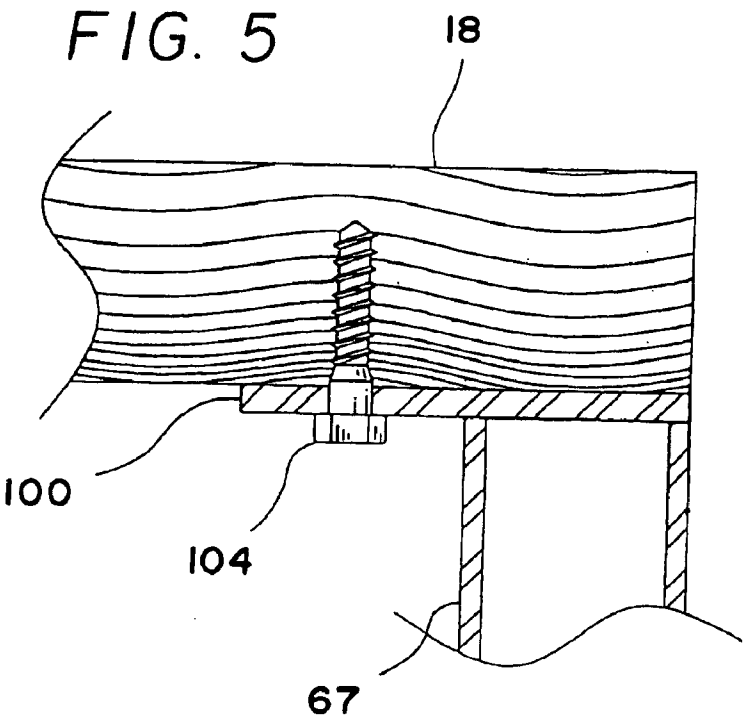
FIG. 5 is a cross-sectional front view of the connection between the sliding frame and the generally planar support surface of a first preferred embodiment of this invention.
Figure 4:
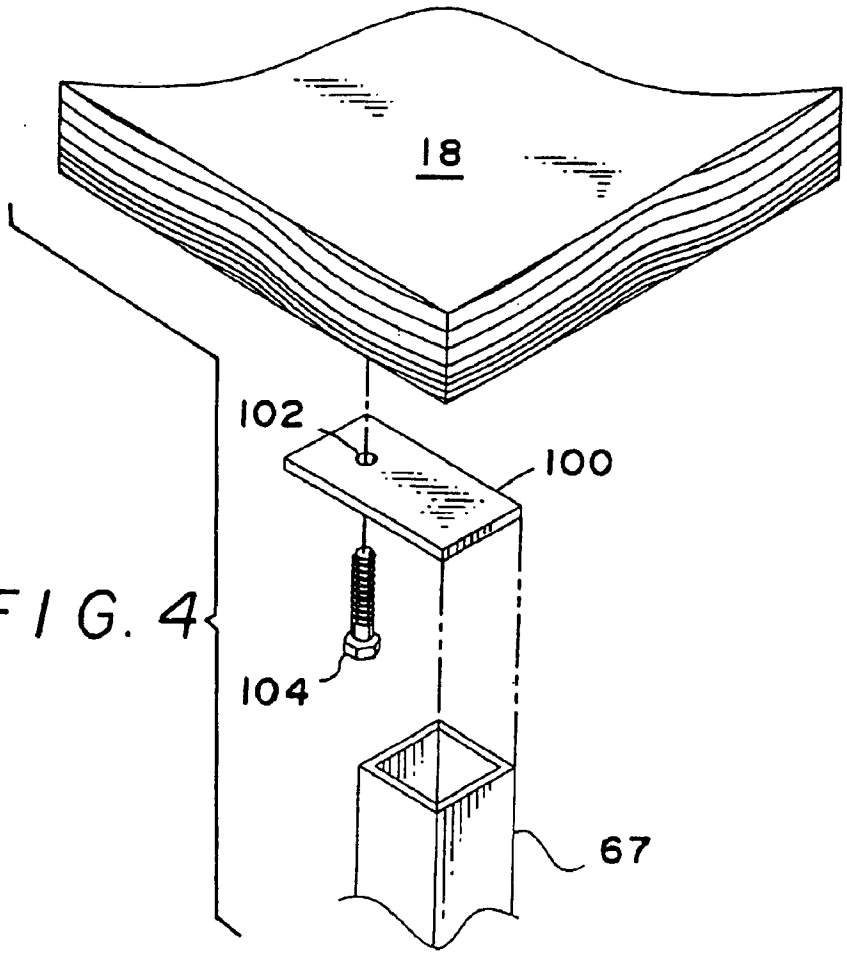
FIG. 4 is an exploded perspective view of the connection between the sliding frame and the generally planar support surface of a first preferred embodiment of this invention.

As best can be seen in FIG. 3, a lifting mechanism 16 is provided between the base frame 12 and the slider frame assembly 14. There are several types of lifting mechanisms that may be used, as long as they easily lift the slider frame assembly 14 relative to the base frame 12 and do not provide for any clutter underneath the table top 18. There is preferably shown a hydraulic pump actuated jack 16 as the lifting mechanism. Specifically, the jack 16 is mounted on the first hollow tubular member 20 of the base frame 12 by two bolts 70 and extends upwardly to the first elongated tubular member 50 of the slider frame assembly 14. The jack 16 is provided with a pair of two piece pivoting arms 72, 74 which, when the adjustable height table is in its down position as shown in FIG. 1, extend longitudinally parallel to the first and second elongated members 20, 50 of the base frame 12 and slider frame assembly 14. With this arrangement, there is much more usable area available under the table top 18 for various items such as cylinders or other types of welding equipment (not shown). The pump pedal assembly 80 which activates the pump 82 of the hydraulic jack 16 is located at 90° to the above-mentioned axis. Thus this pedal assembly 80 extends to a convenient location where an operator may pump up the table 18 as desired. A release pedal 84 is located adjacent the pump pedal assembly 80 and is provided for controlling the release of hydraulic pressure in the jack 16 and thus the decent rate of the table 10. An adjustable screw stop 120 is provided to restrict a downward motion of the release pedal 84. A spring 122 urges the pedal to its uppermost position so that the hydraulic jack 16 will not cause the tabletop 18 to lower inadvertently.

While the use of a hydraulic jack is known in the art, the particular arrangement of the pumping pedal is not. It is therefore important to note that the pumping pedal, as best seen in FIG. 3, is provided with an anti-sway bar 90 connected thereto. This bar has three major functions: first, to keep the pump pedal 88 from swaying from side to side by protruding down through a retaining bracket and its two guide tabs 94, second, to retain the pump pedal return spring 96, and third, to act as a solid stop to the pump pedal return height. At this point it should be realized that the particulars of the working members of the hydraulic jack 16 are not considered novel to this invention and therefore will not be discussed in detail here. Any type of hydraulic, pneumatic or other mechanical jack such as the jack discussed below powered by electric motors may be provided so long as it keeps the areas under the tabletop 18 clear and is easily actuated by the table operator.

In operation, all of the castor wheels 41, 42, 43, 44 of this table 10 may be first unlocked and any items which need to be transported can be placed on the generally planar horizontal tabletop 18. The portable table 10 can then be easily maneuvered due to the swiveling nature of the castors 41, 42, 43, 44. Once the table 10 is put in a preferred spot, the castors 41, 42, 43, 44 may be locked so that the table 10 may no longer roll about.

Items may either be placed upon the tabletop 18 or, in the case of a metal tabletop 18 for example, magnetic clamps (not shown) may be used to hold various work items in place. By repetitively pushing the pumping pedal 88, the hydraulic jack 16 may be actuated to lift the slider frame assembly 14 and tabletop 18 up to a desired height. For example, the table 18 may raise from a lowered position as shown in FIG. 1 to a raised position shown in FIG. 2. When necessary, the release pedal 84 may be actuated to control how fast the tabletop 18 is lowered and to also set its height at a lower position. The speed of the tabletops decent can be controlled by the amount the release pedal 84 is depressed by the operators direct control. However, in most cases, the operator will just push the pedal 84 until it reaches a stop point. This stop point itself is adjusted by rotating screw stop 120 to a desired position. For example, if the screw stop is rotated so that it rises and thus stops the release pedal 84 at a higher position, the valve on the hydraulic jack 16 will release pressure slowly and thus the tabletop 18 will descend slowly. Conversely, if the screw stop 120 is rotated so as to be set at a low position, the release pedal 18 will travel further before it hits the screw stop 120 and thus open the hydraulic jacks valve more, resulting in a swift descent of the tabletop 18. As mentioned above, a spring 122 is provided to ensure the release pedal 84 returns to its uppermost position when the operator is not applying pressure thereto. In this manner, the tabletop is prevented from accidentally descending on its own accord. This easy adjustment of the tabletop height gives the operator an incredible advantage of being able to work on either the front or the back of a workpiece without unnecessary bending or stretching. Due to the nature of the hydraulic jack 16 and its actuators, many items may be stored or placed underneath table 10 during use.

Figure 8:
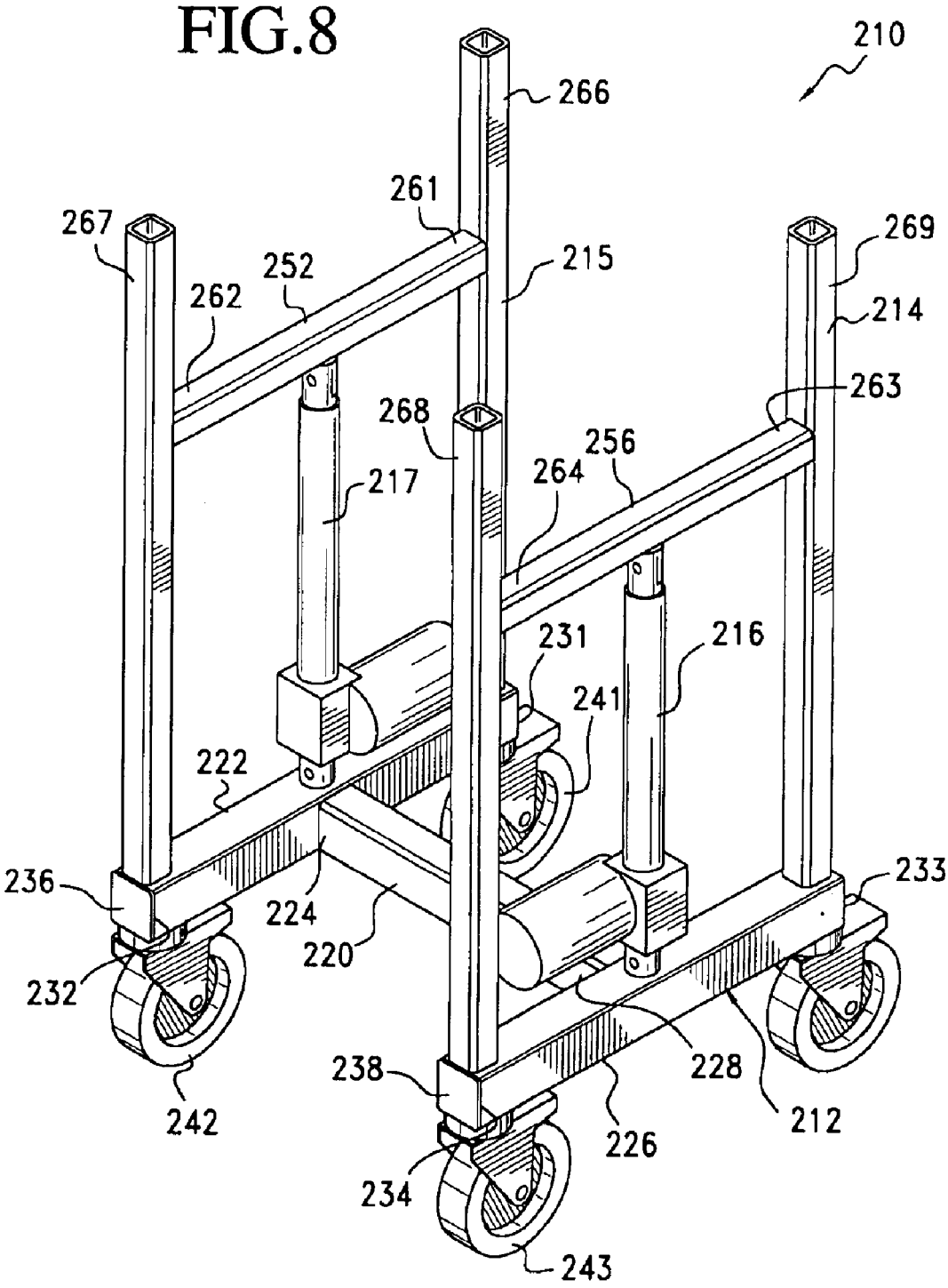
FIG. 8 is a perspective view of the second embodiment of a portable adjustable height load bearing structure in accordance with the principles of the invention wherein the adjustable height load bearing structure is in its lower most adjustable position.
Figure 9:
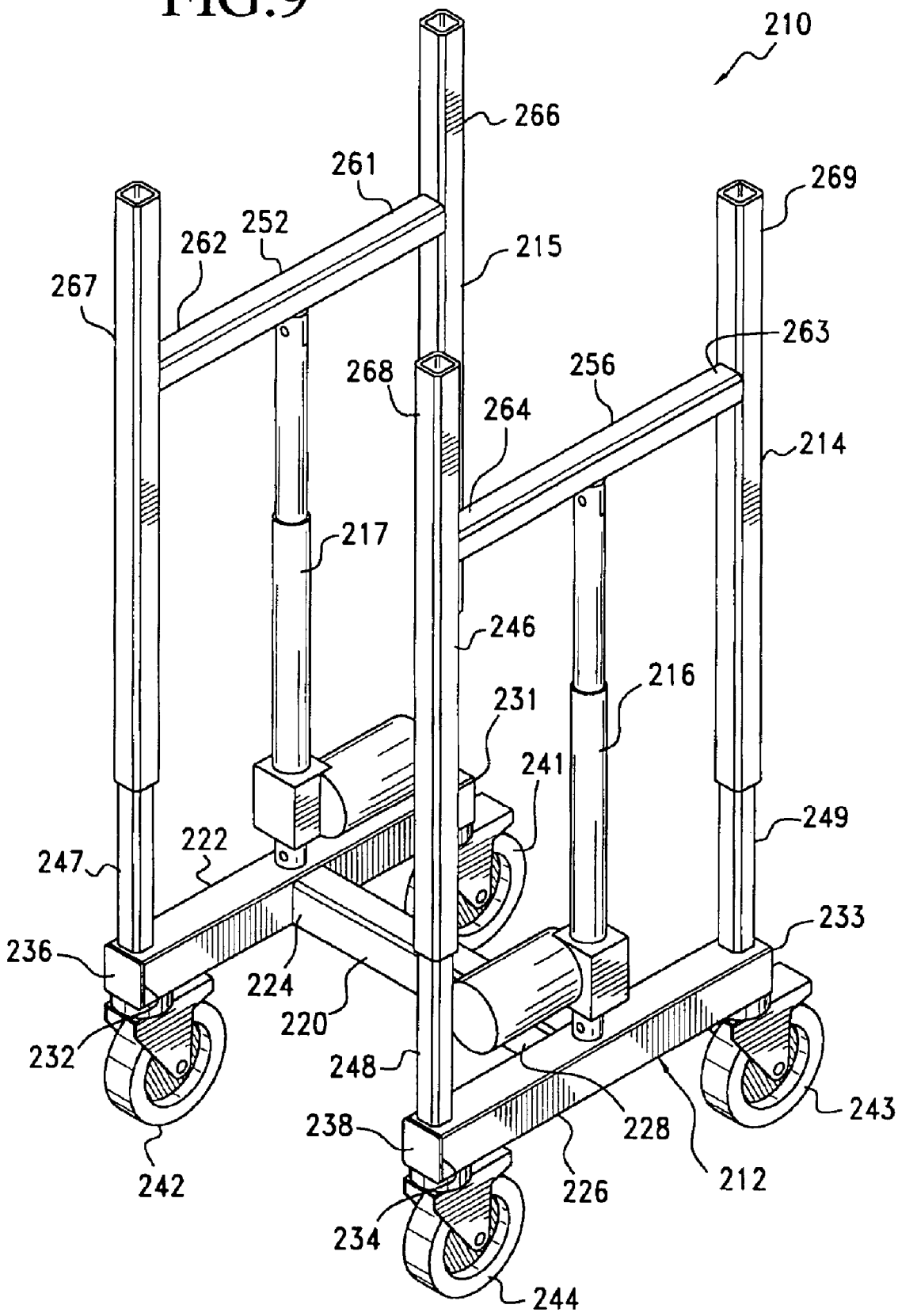
FIG. 9 is a perspective view of the adjustable height load bearing structure of FIG. 8 in its upper most position.
Figure 10:
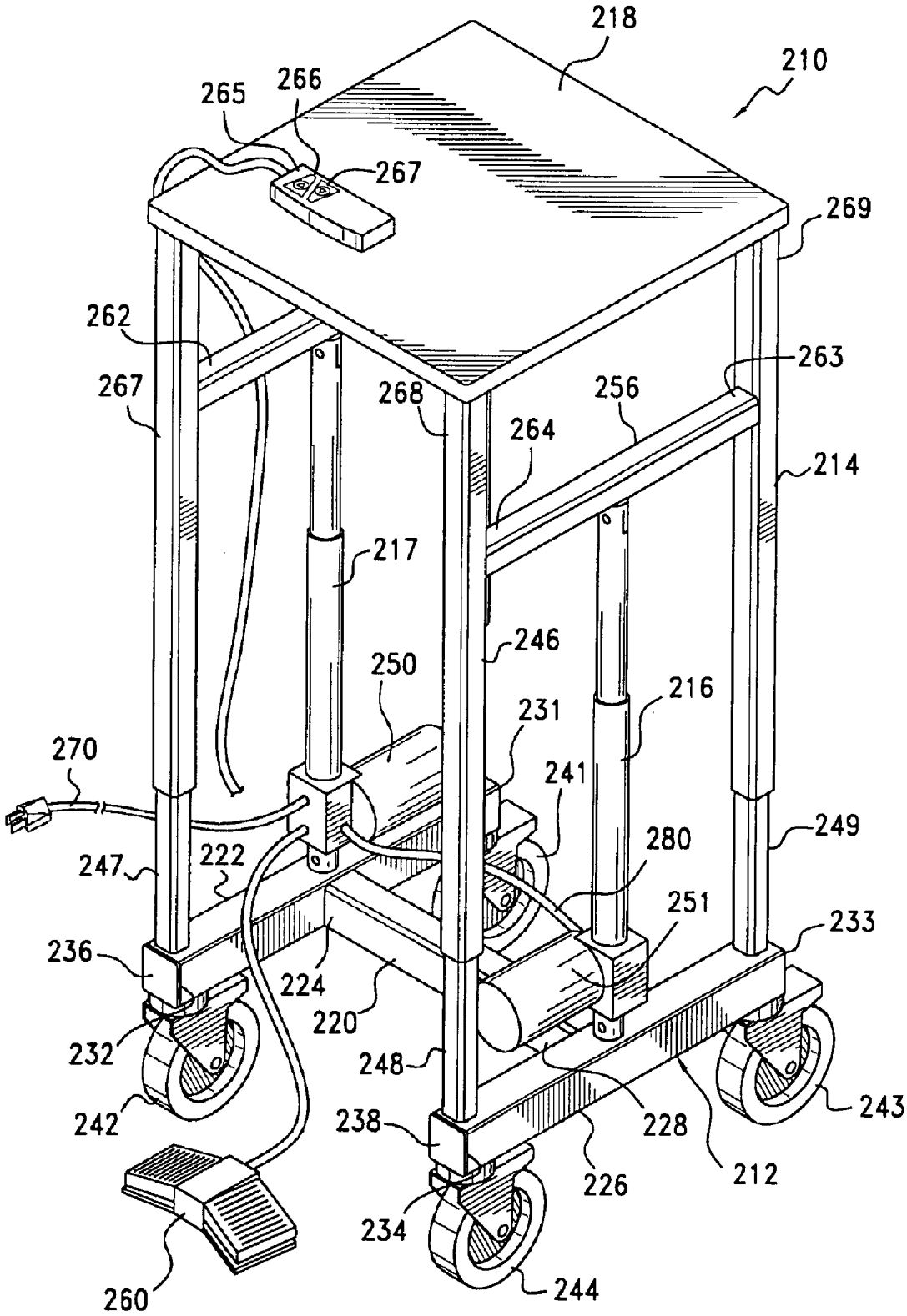
FIG. 10 is a perspective view of the adjustable height load bearing structure including a generally planar support surface mounted on the slider frame assembly.

In another preferred embodiment as shown in FIGS. 8–10 there is shown an adjustable height load bearing structure analogous to the one shown in FIG. 1. An adjustable height table constructed in accordance with the invention is designated by the reference numeral 210 and includes an H-shaped base frame 212, slider frame assembly 214, 215, a lifting mechanism 216, 217 and a generally planar support surface or tabletop 218 which can best be seen in FIG. 10. As can best be seen in FIGS. 8 and 9, the base frame 212 includes a first hollow elongated tubular member 220 extending along a first axis. A second hollow tubular member 222 extends at right angles thereto and is welded at one end 224 of first tubular member 220 and a third tubular member 226 also extends at right angles to the first tubular member 220 and is welded to the other end 228 of the first tubular member 220. The result is a generally H-shaped base frame 212 having four laterally extending arms. These tubular members 220, 222, 226 are preferably made of steel or stainless steel construction and are painted to a desirable color. They could, as in the first embodiment however, also be made of aluminum or other construction materials. At the end of each of the laterally extending arms 231, 232, 233, 234 there is provided a cap 236, 238, (only two are shown) formed to close off the hollow tubes 222, 226. These caps 236, 238 are typically square and made of plastic and are mainly for aesthetic purposes, but they also help to keep dust and other foreign materials out of the H-shaped base frame 212.

The base frame 212 typically extends in a horizontal plane during normal use, attached to the extreme ends of each laterally extending arms 231, 232, 233, 234 and extending in the downward direction is a group of four casters 241, 242, 243, 244. These casters are similar to the ones discussed above in regards to the first embodiment of the invention. At extreme ends of these lateral arms 231, 232, 233, 234 as can best be seen in FIG. 9, there are located four vertically extending hollow tubular posts 246, 247, 248, 249 welded to the laterally extending arms 231, 232, 233, 234. These hollow tubes or posts 246, 247, 248, 249 extend opposite to the casters 241, 242, 243, 244 and preferably extend vertically so as to cooperate with the slider frame assembly 214 as will be more fully discussed below.

Turning now to the slider frame assembly 214, the slider frame assembly 214 also comprises two hollow tubes or members 252, 256 which are in parallel space relationship and made of similar materials to the tubular members 220, 222, 226 and the base frame 12. As shown only with the two parallel tubular members 252 and 256, it should be remembered that the slider frame assembly 214 could also have additional cross bracing such as hollow tubular member 50 shown in FIG. 1. The two parallel tubular members 252, 256 define four lateral arms 261, 262, 263, 264. At the end of each of these lateral arms 261, 262, 263, 264 there is a respective vertically extending tubular column 266, 267, 268, 269 which is welded to the respective laterally extending arms 261, 262, 263, 264. Note that the laterally extending arm 261, 262, 263, 264 of the slider frame assembly 214 are slightly shorter than the laterally extending arms 231, 232, 233, 234 of the base frame 212 and can best be seen in FIGS. 8 and 9. This is to assure that the vertical columns 266, 267, 268, 269 of the slider assembly 212 are positioned so that they may slide telescopingly with the upper ends of the vertically extending post 241, 242, 243, 244 located on the base frame 212.

While all the tubular members shown in FIGS. 8–10 are a square cross-section as mentioned above in regards to the tubular members of the first embodiment any cross-section of the tubular members will do so long as the slider frame assembly 214 and the base frame 212 may cooperate in a telescoping manner. Additionally, the generally planar support surface or tabletop 218 may be made of the various materials described in reference to the discussion in FIGS. 4–7 above. Additionally of course, the various means to attach the generally planar support surface discussed above are equally applicable in this embodiment. As clearly shown in FIGS. 8 and 9 the slider frame assemblies 214 may be sold without any top at all so a customer may provide their own custom made supporting surface.

Turning now to FIG. 8 a pair of lifting mechanisms 216, 217 are provided between the base frame 212 and the slider frame assembly 214. Preferably as shown a pair of electric motors 216, 217 are used as lifting mechanism. Specifically, in reference to one of the lifting members 216 it is mounted on hollow crossbeam 224 at lower end and connected hollow tubular member 252 at its upper end. The second lifting member 217, another electric motor, is connected between the base frame 212 and the slider frame assembly 214 by connecting with hollow tubular member 226 at its lower end and hollow member 256 at its upper end. This specific connection between the lifting mechanism in each hollow tubular member is not important to the invention and could easily be either a pin and slot type connection or alternatively be welded thereto. Since the two lifting mechanisms 216, 217 are not directly located under the supporting table 218 there is much more usable area available under the tabletop 218 for various items such as cylinders or other types of welding equipment (not shown). Preferably the motors may be the Megamat series of motors produced by Derwitt Corporation a subsidiary of Phoenix Mecano. Typically such motors are available in four different load capacities which are 1,500 newtons, 2,000 newtons, 4,000 newtons and 6,000 newtons. Ideally the load capacity would be matched with a final users desires depending on what type of load or usage the base 210 will be used for.

As can best be seen in FIG. 10, motors 250 251 are operated by electric power and an operator has control of the base's height by using electrical switches 260, 265. The switches 260, 265 are available in different styles such as foot switch 260 or a manual switch 265 with buttons 266, 267. The motors 250, 251 are supplied by a cord 270 that can be plugged into a electric power source. While the base 210 can have any adjustable range, preferably an adjustable range of nine inches has been found to be useful. In use an operator can set the base to any height within this nine inch range by simply letting go of the switch 260, 265 when the base gets the desired height. Since the two motors 250, 251 are connected electrically by cord 280, they rise and fall at the same rate.

As with the embodiment shown in FIG. 1, in operation of this embodiment, all the caster wheels 241, 242, 243, 244 may be first unlocked and any items which need to be transported can be placed in the generally horizontal tabletop 218. The portable unit then can be easily maneuvered due the swiveling nature of the casters 241, 242, 243, 244. Once the table 210 is put in the preferred spot, the casters 241, 242, 243, 244 may be locked so that the table 210 may no longer roll about. Items may either be placed on the tabletop 218 or, in case of the metal tabletop 218 for example, magnetic clamps (not shown) may be used to hold the various work items in place. As mentioned above by pushing the electric buttons or controls 260, 265 to the electric motors 250, 251 the height of the slider frame assembly 214 and tabletop 218 may be raised to a desired height. It should be noted that stops (not shown) are provided at the upper and lower limits of travel of the slider assembly 214.

While the invention has been described in connection with the preferred embodiments thereof, it would be apparent to those skilled in the art that many changes and modifications may be made without departing from the spirit and scope of the invention. Furthermore, it should be noted that none of the aforesaid detail description should be considered to limit the scope of the invention.

I claim:

1. An adjustable height loading bearing structure comprising:

a base frame;

a slider frame assembly mounted on said base frame having at least two legs connected by tubular member; and a lifting mechanism attached to said base frame for moving said slider frame relative to said base frame, wherein said base frame has an H-shaped main body which connects four vertically extending posts.

2. A structure according to claim 1, wherein said lifting mechanism is an electrical motor.

3. A structure according to claim 2, wherein said lifting mechanism comprises two separate electric motors.

4. A structure according to claim 2, further comprising a generally planar support surface mounted on said slider frame.

5. A portable, adjustable height load bearing structure comprising:

a base frame;

a slider frame assembly mounted on said base frame; and a lifting mechanism attached to said base frame, said lifting mechanism having a first actuator usable by an operator to move the slider frame in a first direction, a second actuator usable by the operator to move the slider frame in a second direction, wherein said base frame has an H-shaped main body portion which connects four vertically extending posts.

6. A structure according to claim 5, wherein said lifting mechanism is an electric motor.

7. A structure according to claim 6, wherein said lifting mechanism is a pair of motors.

8. A structure according to claim 7, further comprising a generally planar support surface mounted on said slider frame assembly.

9. A structure according to claim 5, wherein said first actuator is a button and said second actuator is a second button.

* * * * *